US010441834B2

(12) United States Patent
Liu et al.

(10) Patent No.: US 10,441,834 B2
(45) Date of Patent: Oct. 15, 2019

(54) EXERCISE MACHINE WITH VARIABLE RESISTANCE

(71) Applicant: Dyaco International Inc., Taipei (TW)

(72) Inventors: Shih-Wei Liu, Taipei (TW); Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 155 days.

(21) Appl. No.: 15/802,343

(22) Filed: Nov. 2, 2017

(65) Prior Publication Data

US 2019/0118021 A1 Apr. 25, 2019

(30) Foreign Application Priority Data

Oct. 23, 2017 (TW) ..... 106136394 A

(51) Int. Cl.
*A63B 21/00* (2006.01)
*A63B 69/06* (2006.01)
(Continued)

(52) U.S. Cl.
CPC .... *A63B 21/00069* (2013.01); *A63B 21/0084* (2013.01); *A63B 22/0076* (2013.01);
(Continued)

(58) Field of Classification Search
CPC ..... A63B 21/00058; A63B 21/00069; A63B 21/00072; A63B 21/00076; A63B 21/008; A63B 21/0084; A63B 21/0085; A63B 21/0088; A63B 21/0602; A63B 21/22; A63B 21/4027; A63B 21/4029; A63B 21/4031; A63B 21/4033; A63B 21/4034; A63B 21/4035; A63B 21/4041; A63B 21/4045; A63B 21/4047; A63B 21/4049;
(Continued)

(56) References Cited

U.S. PATENT DOCUMENTS 2,586,024 A * 2/1952 Glasgow ..... A63B 69/08 297/344.1
2,725,231 A * 11/1955 Hoover ..... A63B 21/153 482/112
(Continued)

FOREIGN PATENT DOCUMENTS

CN 1538860 A 10/2004
TW M554814 U 2/2018

OTHER PUBLICATIONS

Office Action dated Jun. 13, 2018 in corresponding Taiwan Patent Application No. 106136394.

*Primary Examiner* — Gary D Urbiel Goldner
(74) *Attorney, Agent, or Firm* — Donald E. Stout; Stout, Uxa & Buyan, LLP

(57) ABSTRACT

This invention discloses an exercise machine with adjustable resistance. The exercise machine includes a fluid container, one or more paddles, a driving device, and an adjusting device. The one or more paddles are arranged in the fluid container into which a fluid is poured. The driving device comprises an adjusting rod to couple with the one or more paddles. The driving device transmits a user's force for driving the one or more paddles to rotate. The adjusting device can adjust a depth of the one or more paddles in the fluid, so as to provide differing degrees of resistance for the one or more paddles.

8 Claims, 14 Drawing Sheets

(51) Int. Cl.
*A63B 21/008* (2006.01)
*A63B 22/00* (2006.01)

(52) U.S. Cl.
CPC ..... *A63B 69/06* (2013.01); *A63B 21/008* (2013.01); *A63B 21/00072* (2013.01); *A63B 22/0087* (2013.01); *A63B 2022/0079* (2013.01)

(58) Field of Classification Search
CPC ..... A63B 22/0046; A63B 22/0076; A63B 22/0087; A63B 2022/0079; A63B 2022/0082; A63B 2022/0084; A63B 69/06; A63B 2069/062; A63B 2069/064; A63B 2069/066; A63B 2069/068; A63B 2069/08; A63B 71/0054; A63B 2071/0063; A63B 2071/0072; A63B 2071/0081; A63B 2071/009; A63B 2208/0228; A63B 2208/0233; A63B 2208/0238; A63B 2225/09; A63B 2225/093
See application file for complete search history.

(56) References Cited

U.S. PATENT DOCUMENTS 3,266,801 A * 8/1966 Johnson ..... A63B 22/0076 482/112
4,396,188 A * 8/1983 Dreissigacker .... A63B 22/0076 482/110
4,743,011 A * 5/1988 Coffey ..... A63B 21/0088 482/111
4,846,460 A * 7/1989 Duke ..... A63B 21/153 482/73
4,884,800 A * 12/1989 Duke ..... A63B 21/154 482/73
4,903,961 A * 2/1990 Solymosi ..... A63B 69/08 4/497
5,306,219 A * 4/1994 Solymosi ..... A63B 69/08 482/111
5,382,211 A * 1/1995 Solymosi ..... A63B 69/08 482/72
5,562,576 A * 10/1996 Mangine ..... A63B 69/08 482/72
5,707,322 A * 1/1998 Dreissigacker ..... A63B 21/227 482/72
6,561,955 B1 * 5/2003 Dreissigacker .. A63B 21/00069 482/51
7,572,211 B2 * 8/2009 Roach ..... A63B 22/0076 482/51
7,628,739 B2 * 12/2009 Gearon ..... A63B 22/0007 188/290
7,862,484 B1 * 1/2011 Coffey ..... A63B 21/157 482/72
8,038,582 B2 * 10/2011 Edmondson ..... A63B 22/0046 482/72
8,192,332 B2 * 6/2012 Baker ..... A63B 22/0076 482/133
8,708,867 B2 * 4/2014 Lumsden ..... A63B 22/0076 482/71
10,155,131 B2 * 12/2018 Machovina ..... A63B 22/0076
10,279,214 B2 * 5/2019 Chiang ..... A63B 22/0076
2005/0014611 A1 * 1/2005 Gearon ..... A63B 22/0007 482/73
2017/0209729 A1 * 7/2017 King ..... A63B 21/0084
2018/0056118 A1 * 3/2018 Bates ..... A63B 21/4035

* cited by examiner

EXERCISE MACHINE WITH VARIABLE RESISTANCE

CROSS-REFERENCE TO RELATED APPLICATIONS

The entire contents of Taiwan Patent Application No. 106136394, filed on Oct. 23, 2017, from which this application claims priority, are expressly incorporated herein by reference.

BACKGROUND OF THE INVENTION

1. Field of the Invention

The present invention relates to an exercise machine, and more particularly relates to an exercise machine with variable resistance.

2. Description of Related Art

An indoor rower or rowing machine is a machine used to simulate the action of watercraft rowing for the purpose of exercise or training for rowing.

An U.S. Pat. No. 4,884,800 discloses a rowing machine featuring a hollow container that holds a supply of water. Pulling on a drive cord during a pulling segment of a stroke rotates a paddle or like mechanism located within the container to rotate the water to produce a momentum effect. Turbulence in the water provides fluid resistance to the rotation of the paddle. The resistance of the rowing machine cannot be adjusted in this patent.

Another U.S. Pat. No. 7,628,739 discloses a rowing device providing variable resistance. The rowing device has a primary fluid chamber and a secondary chamber. A rotating mechanism rotates within the primary chamber. The rotation mechanism upon rotation encounters a degree of resistance dependent on the amount of fluid in the primary chamber. The secondary chamber is positioned within or proximate the primary chamber. The secondary chamber achieves and maintains an appropriate amount of the fluid in the primary chamber to provide a selected degree of resistance for the exercise machine. Fluid flows through the primary chamber into the secondary chamber and then back into the primary chamber. Variable control of the flow of fluid serves to establish and maintain the appropriate amount of fluid in the primary chamber required for a certain degree of resistance; and can provide differing degrees of resistance for the exercise machine.

SUMMARY OF THE INVENTION

In one general aspect, the present invention relates to an exercise machine with variable resistance.

According to an aspect of this invention, an exercise machine is provided with a fluid container, one or more paddles, a driving device, and an adjusting device. A fluid is poured into the fluid container. The one or more paddles are arranged in the fluid container. The driving device comprises an adjusting rod to couple with the one or more paddles, an operator exerting a force on the driving device to rotate the one or more paddles via the adjusting rod. The adjusting device adjusts a depth of the one or more paddles in the fluid, so as to provide different degrees of resistance for the paddles.

In one embodiment, the adjusting device comprises a knob and a linking mechanism coupled with the knob and the adjusting rod, and the knob can be rotated so as to adjust the depth of the paddles via the linking mechanism.

In one embodiment, the linking mechanism comprises a lateral tube, a base, a pivotal base, a linking arm, and a nut, and wherein the lateral tube is arranged between and connected with two side tubes of the exercise machine, the pivotal base couples to the bottom of the lateral tube, the base fixes with the linking arm and pivotally couples with the pivotal base, the knob is threaded to engage with the nut and then fixes with the base, and a front end of the linking arm couples with the adjusting rod.

In one embodiment, the front end of the linking arm includes two slots and a fixing component is within each slot and fixed with an upper end of the adjusting rod.

In one embodiment, the adjusting device comprises a control knob, and an upper portion or end of the adjusting rod is threaded to engage with an internal thread of the control knob, and wherein the control knob is rotated to make an upward or downward movement of the adjusting rod.

In one embodiment, the adjusting device further comprises a nut and a pedestal, the nut is fixed on the pedestal, and the pedestal is fixed with an upper supporting tube.

In one embodiment, the adjusting device comprises a shaft, a control member, an outer shell, two springs, a supporting plate, and a connecting member, and wherein the supporting plate is fixed with the exercise machine, the shaft passes through the outer shell and has an upper end coupled with the supporting plate and a lower end coupled with an upper supporting tube of the exercise machine, the control member is inserted into an aperture of the outer shell, the two springs are arranged inside the outer shell, each spring includes a first end coupled with an inner wall of the outer shell and a second end coupled with the control member, and the connecting member includes a front end coupled with the adjusting rod a rear end coupled with the outer shell.

In one embodiment, when the control member is not operated, an inside diameter of the two springs is smaller than an outside diameter of the shaft; and when the control member is operated, the inside diameter of the two springs is greater than the outside diameter of the shaft.

In one embodiment, the exercise machine is a rowing machine that comprises a front tube, a rear tube, two side tubes, an upper supporting tube, a guiding track, a seat, and two pedals, and wherein the two side tubes are connected with each other and each side tube includes a front end coupled with the front tube and a rear end coupled with a front end of the guiding track, the two pedals respectively couple or pivotally couple with a left side and a right side of the guiding track, the upper supporting tube is arranged between the two side tubes and connected with the two side tubes, a rear end of upper supporting tube couples with the front end of guiding track, a rear end of guiding track couples with the rear tube, and the seat can slide forward and backward on the guiding track by a wheel.

In one embodiment, the driving device further comprises a handle, one or more rollers, a belt receiver, a belt, and a returning device, and wherein a lower end of the adjusting rod couples with the one or more paddles, the belt receiver includes a one-way bearing and its center couples with the adjusting rod, the belt wraps around the belt receiver and is pulled out the belt receiver, and the rollers change the direction of the belt that then couples with the handle.

DETAILED DESCRIPTION OF THE PREFERRED EMBODIMENT

Figure 1A:
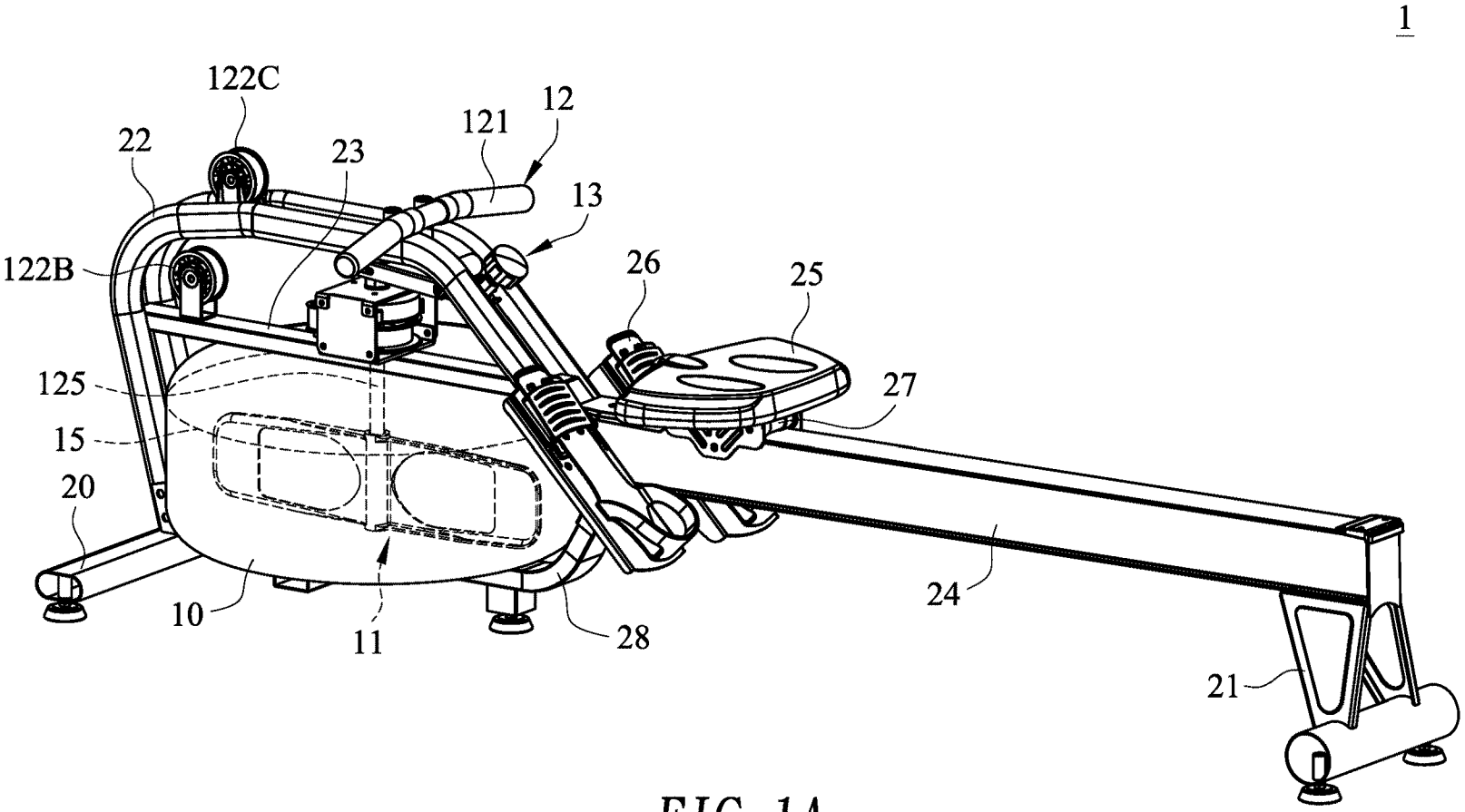
FIG. 1A is a perspective view showing an exercise machine with variable resistance in accordance with a first embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1A is a perspective view showing an exercise machine 1 with variable resistance in accordance with a first embodiment of this invention. Referring to FIG. 1A, the exercise machine 9 includes a fluid container 10, one or more paddles 11, a driving device 12, and an adjusting device 13. A fluid 15 is poured into the fluid container 10. The fluid 15 is preferably water, but it can also be oil or other solutions or fluids with or without additives. The fluid container 10 may also have an aperture (not show) for pouring the fluid 15 into the fluid container 10 or adjusting the level of the fluid 15.

The one or more paddles 11 are arranged in the fluid container 10. An operator can exert a force by the driving device 12 for driving the one or more paddles 11 to rotate. In addition, the operator can adjust the depth of the paddles 11 in the fluid 15, so as to change degrees of resistance for the paddles 11, and thus the exercise machine 1 can have different degrees of resistance.

Referring to FIG. 1, the exercise machine 1 is preferably, but is not limited to, a rowing machine. As an illustration, the exercise machine 1 includes a front tube 20, a rear tube 21, two side tubes 22, an upper supporting tube 23, a guiding track 24, a seat 25, and two pedals 26. The two side tubes 22 are connected with each other and each side tube 22 has a front end coupled with the front tube 20 and a rear end coupled with the front end of the guiding track 24. The two pedals 26 couple or pivotally couple with a left side and a right side of the guiding track 24, respectively. The upper supporting tube 23 is arranged between the two side tubes 22 and connected with the two side tubes 22. The rear end of upper supporting tube 23 couples with the front end of guiding track 24, and the rear end of guiding track 24 couples with the rear tube 21. In addition, the seat 25 can slide forward and backward on the guiding track 24 by a wheel 27. In addition, a detachable frame 28 is arranged between the front tube 20 and the guiding track 24 for supporting the fluid container 10. The frame 28 may have, but is not limited to, a cross-shaped configuration.

Figure 1B:
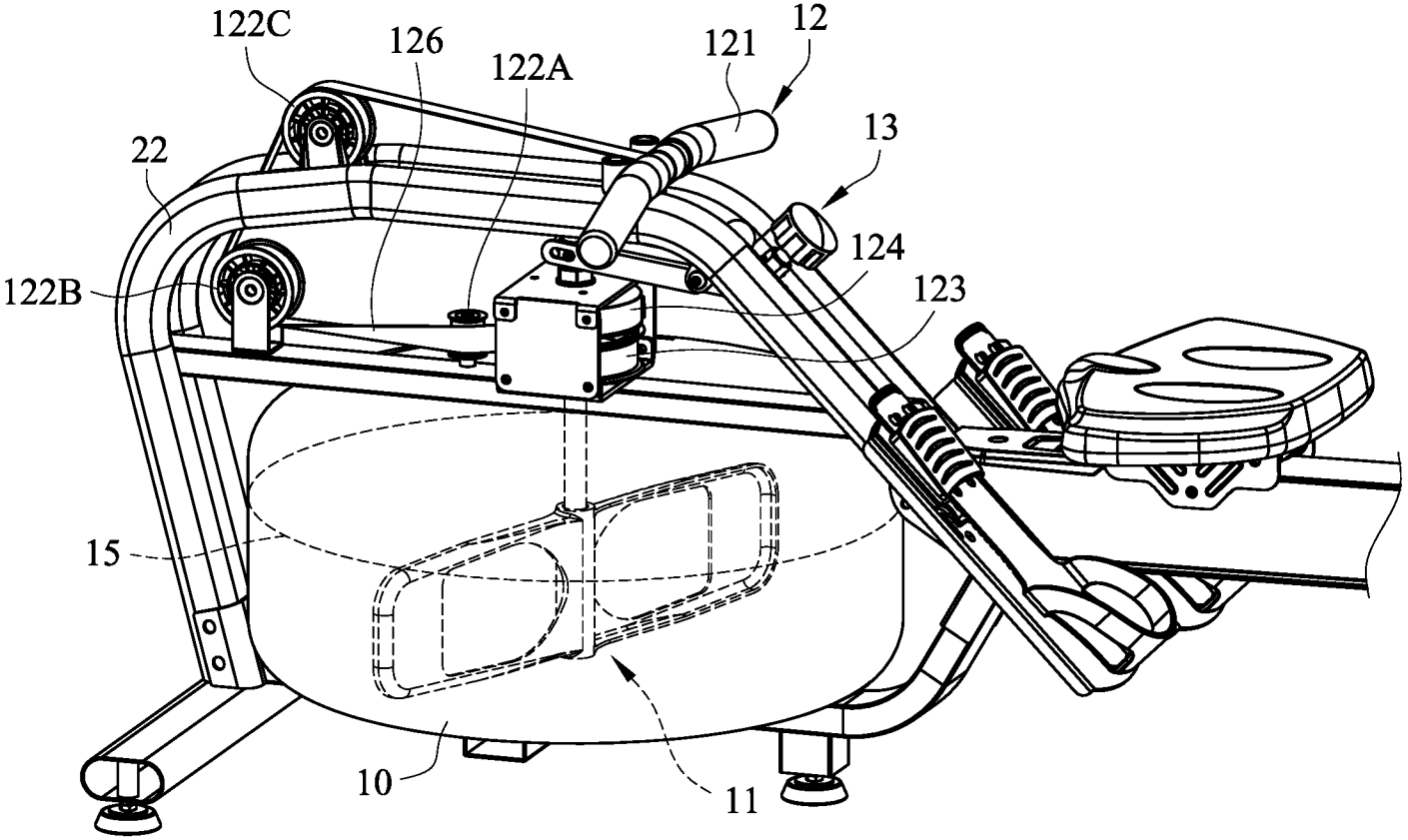
FIG. 1B is a partially perspective view showing a driving device of the exercise machine with variable resistance in accordance with the first embodiment of the present invention.

FIG. 1B is a partially perspective view showing the driving device 12 of the exercise machine 1 in accordance with the first embodiment of this invention. Referring to FIGS. 1A and 1B, the driving device 12 may include a handle 121, one or more rollers 12A/B/C, a belt receiver 123, a returning device 124, and an adjusting rod 125. The lower end of the adjusting rod 125 couples with the one or more paddles 11. The belt receiver 123 includes a one-way bearing (not shown) and its center couples with the adjusting rod 125. A belt 126 wraps around the belt receiver 123 and is pulled out the belt receiver 123. The rollers 122A, 122B, and 122C change the direction of the belt 126, which then couples with the handle 121. The number and position of rollers 122A/B/C can be altered if necessary. The operator sits on the seat 25 with his or her feet respectively to be placed on left and right pedals 26 and hands to hold the handle 121. The belt receiver 123 will rotate when the belt 126 is pulled by the handle 121, and the paddles 11 will rotate with the belt receiver 123. The returning device 124 couples with the belt receiver 123 and rotates with the belt receiver 123. The returning device 124 is used to retrieve the belt 126 back to the belt receiver 123. The returning device 124 may include a spiral spring (not shown) for providing a force to retrieve the belt 126 back to the belt receiver 123.

Figure 2A:
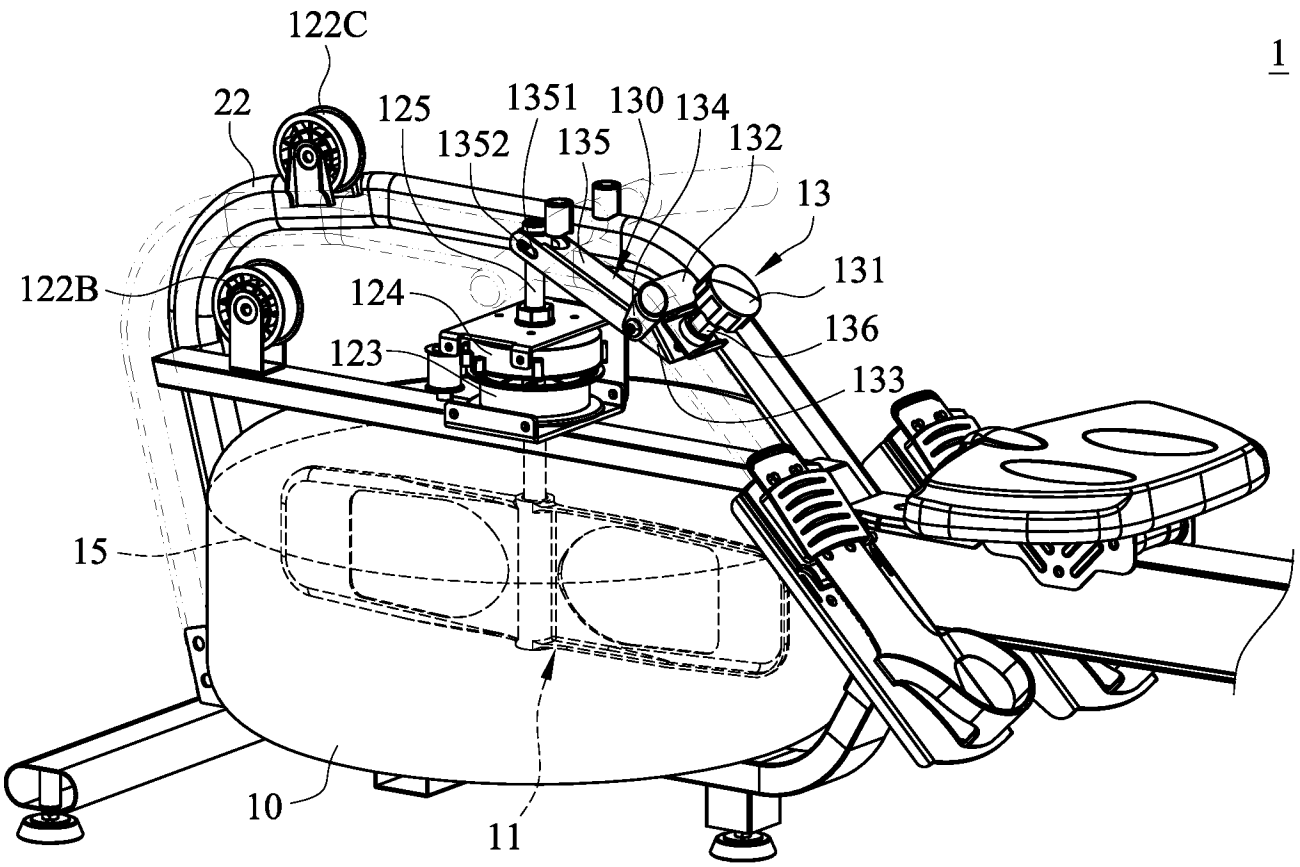
FIG. 2A is a partially perspective view showing the exercise machine with variable resistance in accordance with the first embodiment of the present invention.
Figure 2B:
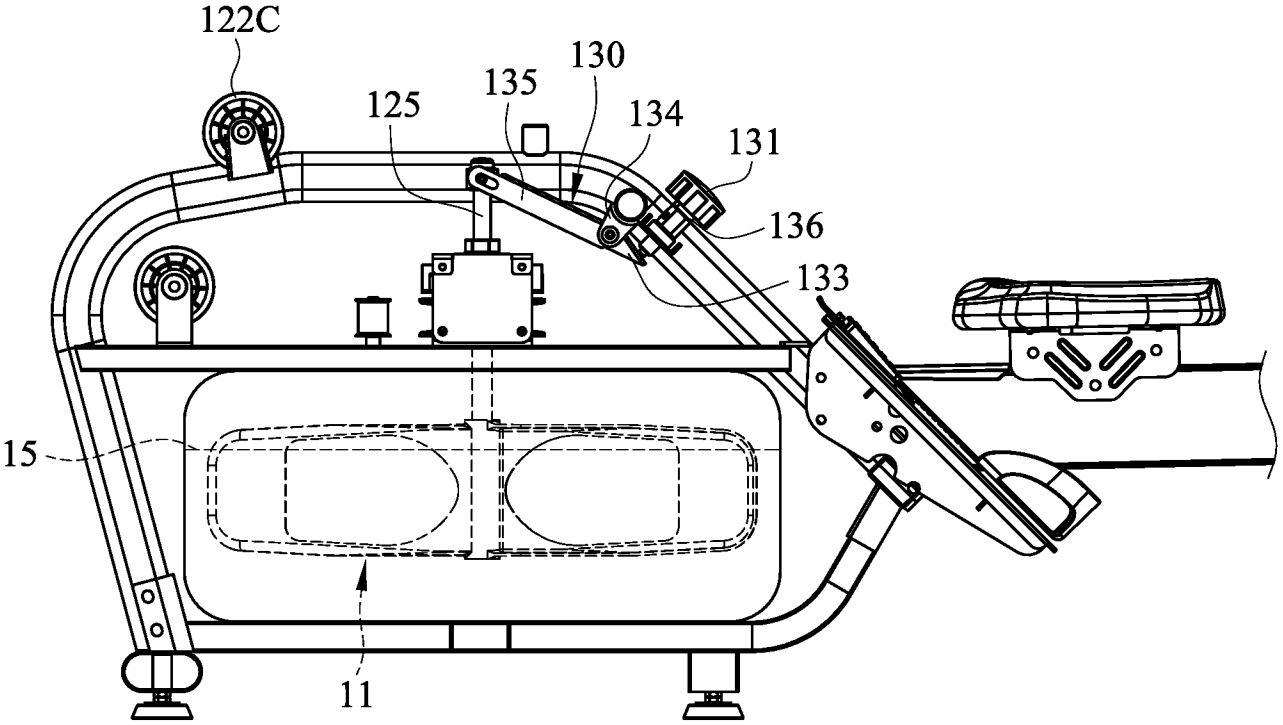
FIG. 2B is a partially side view showing the exercise machine with variable resistance in accordance with the first embodiment of the present invention.
Figure 2C:
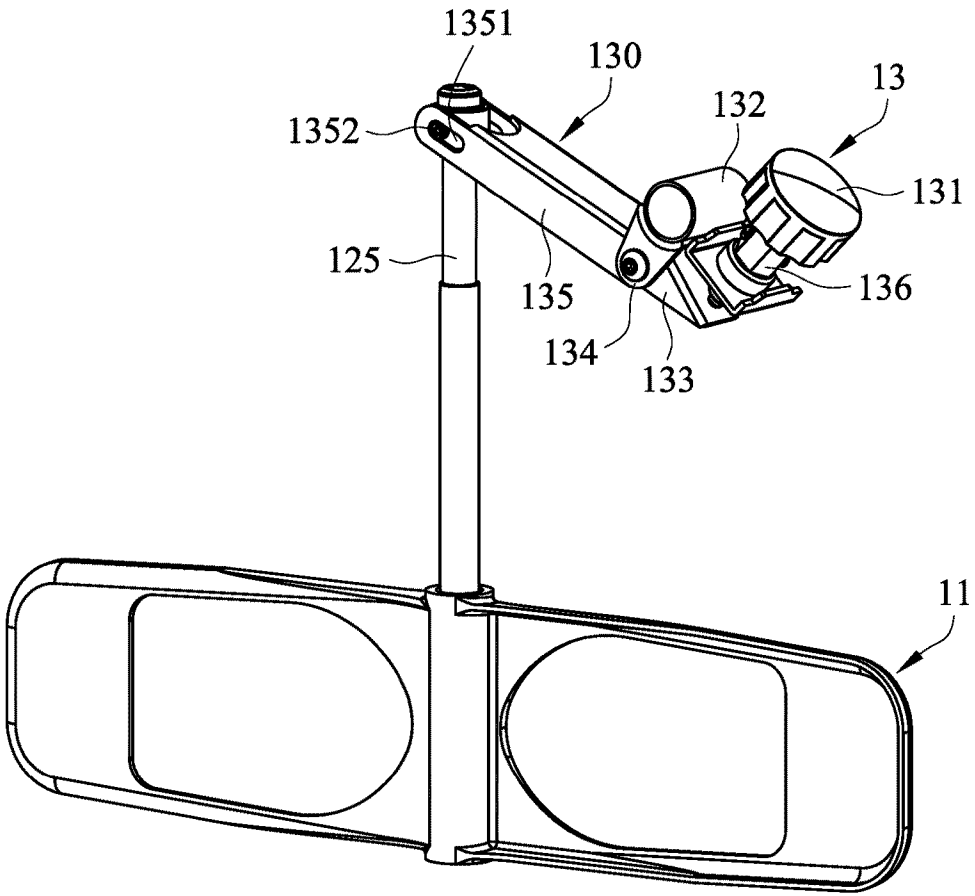
FIG. 2C is a partially perspective view showing an adjusting device of the exercise machine with variable resistance in accordance with the first embodiment of the present invention.
Figure 3A:
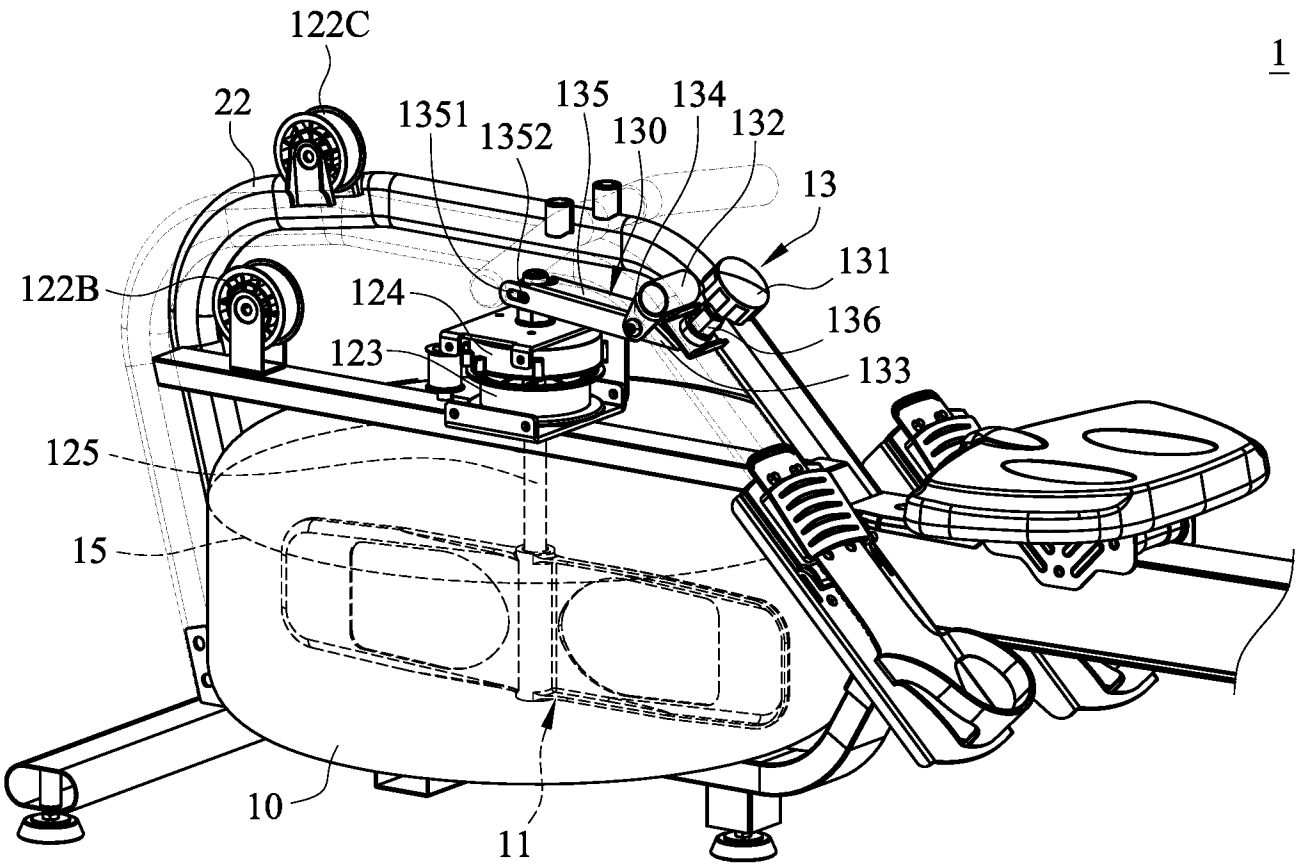
FIG. 3A is a partially perspective view showing the exercise machine with variable resistance in accordance with the first embodiment of the present invention.
Figure 3B:
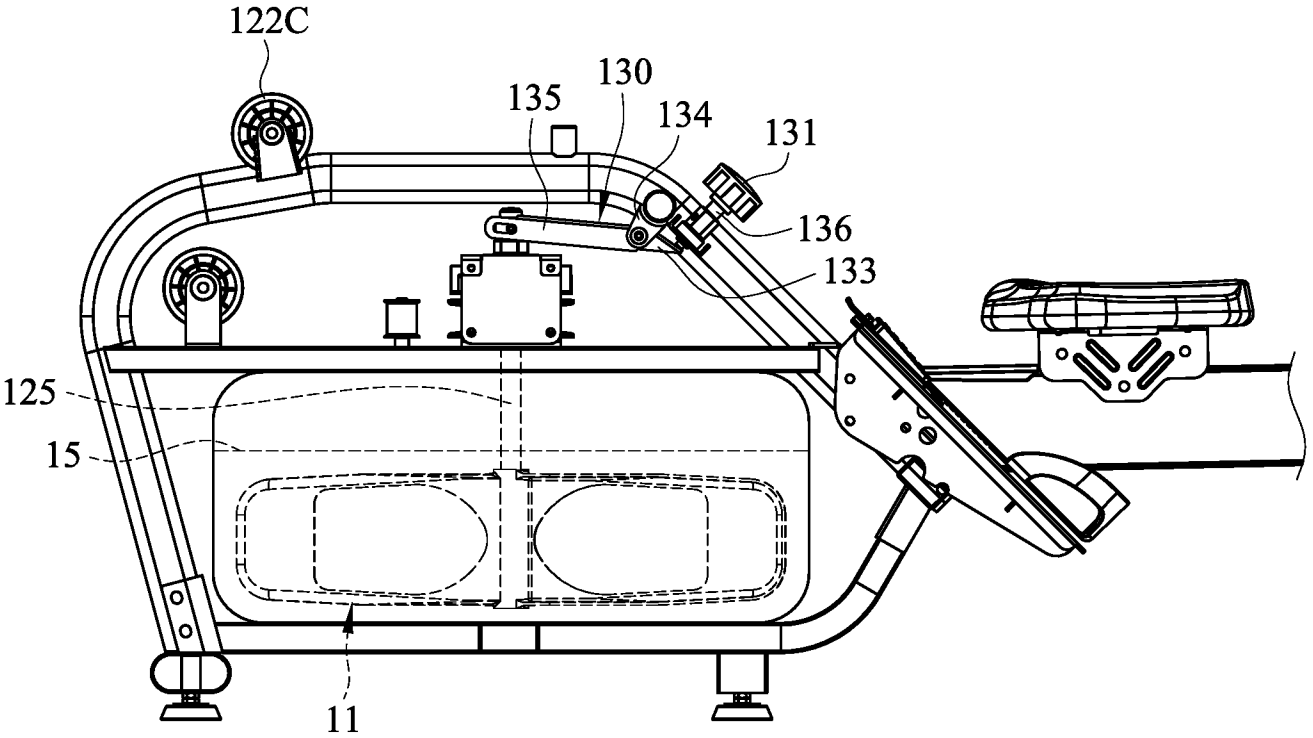
FIG. 3B is a partially side view showing the exercise machine with variable resistance in accordance with the first embodiment of the present invention.

FIGS. 2A and 3A are partially perspective views and FIGS. 2B and 3B are partially side views showing the exercise machine 1 in accordance with the first embodiment of this invention. For clarity, some components are omitted from the drawings. Referring to FIGS. 1A-3B, the adjusting device 13 may include a linking mechanism 130 and a knob 131 coupled with the linking mechanism 130. The knob 131 can be rotated so as to adjust the depth of the one or more paddles 11 via the linking mechanism 130.

FIG. 2C is a partially perspective view showing the detail of adjusting device 13. Referring to FIGS. 1-3B, the linking mechanism 130 may include a lateral tube 132, a base 133, a pivotal base 134, a linking arm 135, and a nut 136. The lateral tube 132 is arranged between and connected with the two side tubes 22. The pivotal base 134 couples to the bottom of the lateral tube 132. The base 133 fixes with linking arm 135 and pivotally couples with the pivotal base 134. In practical, the base 133 and the linking arm 135 can be integrally formed. The knob 131 is threaded to engage with the nut 136 and then fixes with the base 133. The front end of the linking arm 135 includes two slots 1351 and a fixing component 1352 is within each slot 1351 and fixed with upper end of adjusting rod 125.

Referring to FIGS. 1A-3B, the operator 131 can rotate the knob 131 to lift or lower the adjusting rod 125 via the linking arm 135, resulting in different depths of the paddles 11 in the fluid 15 and hence different resistance for the paddles 11. The exercise machine 1 with different degrees of resistance is therefore can be provided. FIGS. 2A and 2B show that the knob 131 is rotated to press the base 133, so that the front end of the linking arm 135 is lifted and hence the adjusting rod 125 is raised, leading to upward movement of the paddles 11. The depth of the paddles 11 in the fluid is decreased and hence the resistance is decreased. FIGS. 3A and 3B show that the knob 131 is rotated to raise the base 133, so that the front end of the linking arm 135 is lowered and hence the adjusting rod 125 is lowered, leading to downward movement of the paddles 11. The depth of the paddles 11 in the fluid is increased and hence the resistance is increased. The degree of resistance can be adjusted by rotating the knob 131 to a proper position.

Figure 4:
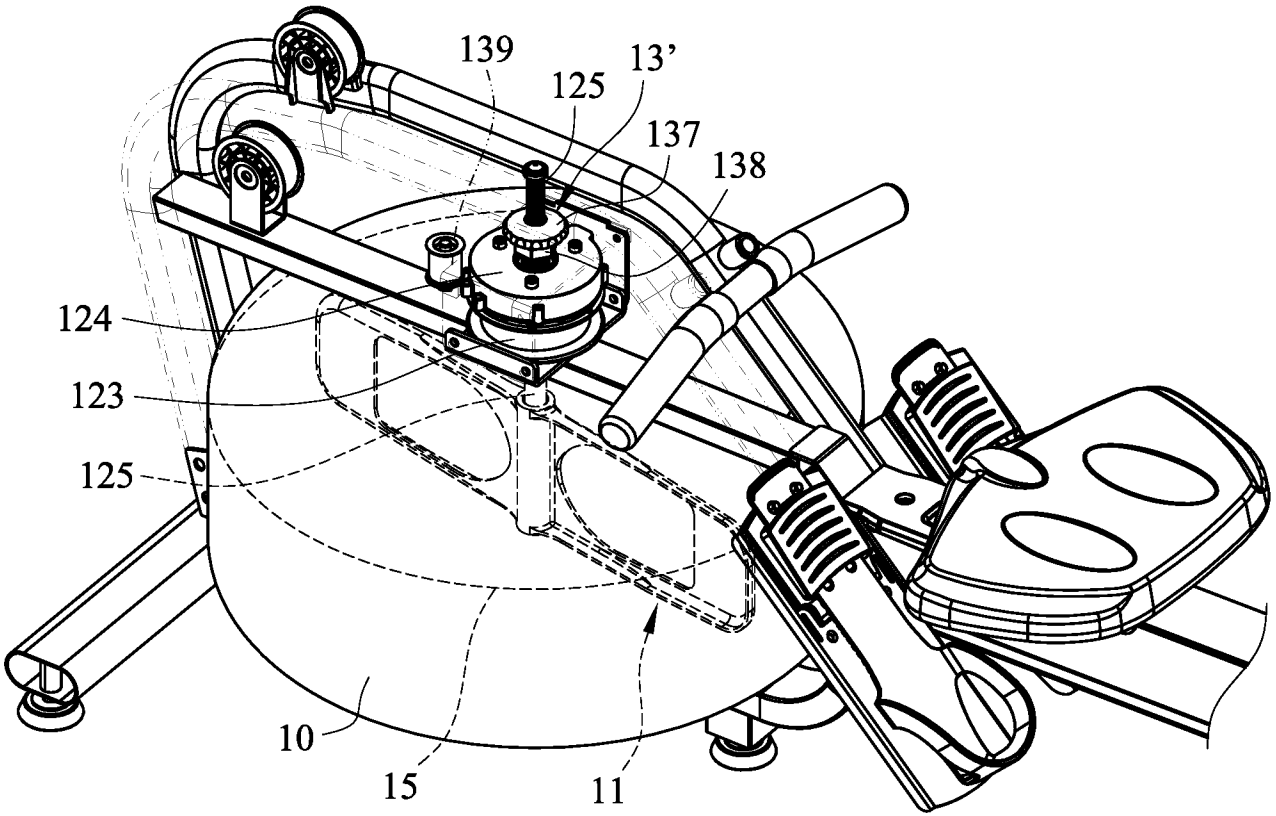
FIG. 4 is a partially perspective view showing an exercise machine with variable resistance in accordance with a second embodiment of the present invention.
Figure 5:
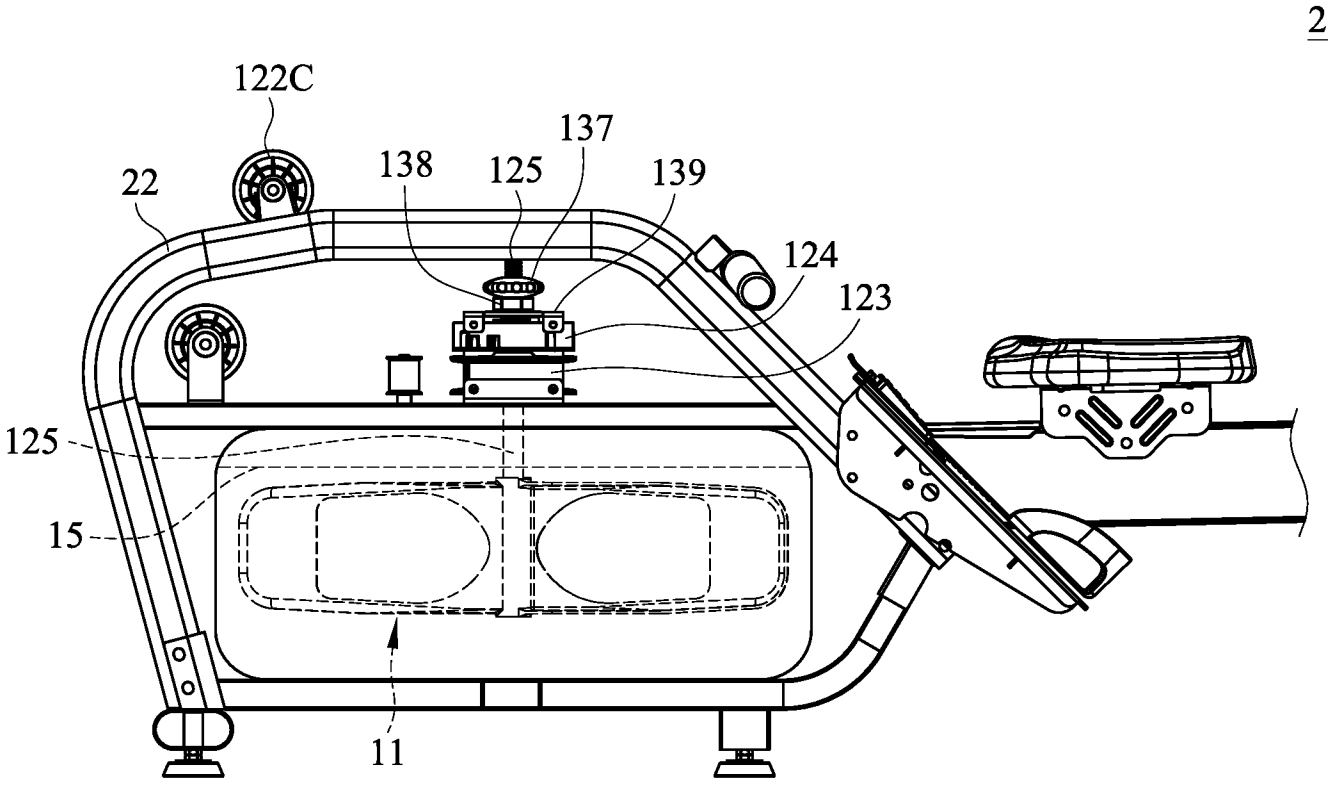
FIG. 5 is a partially side view showing the exercise machine with variable resistance in accordance with the second embodiment of the present invention.
Figure 6:
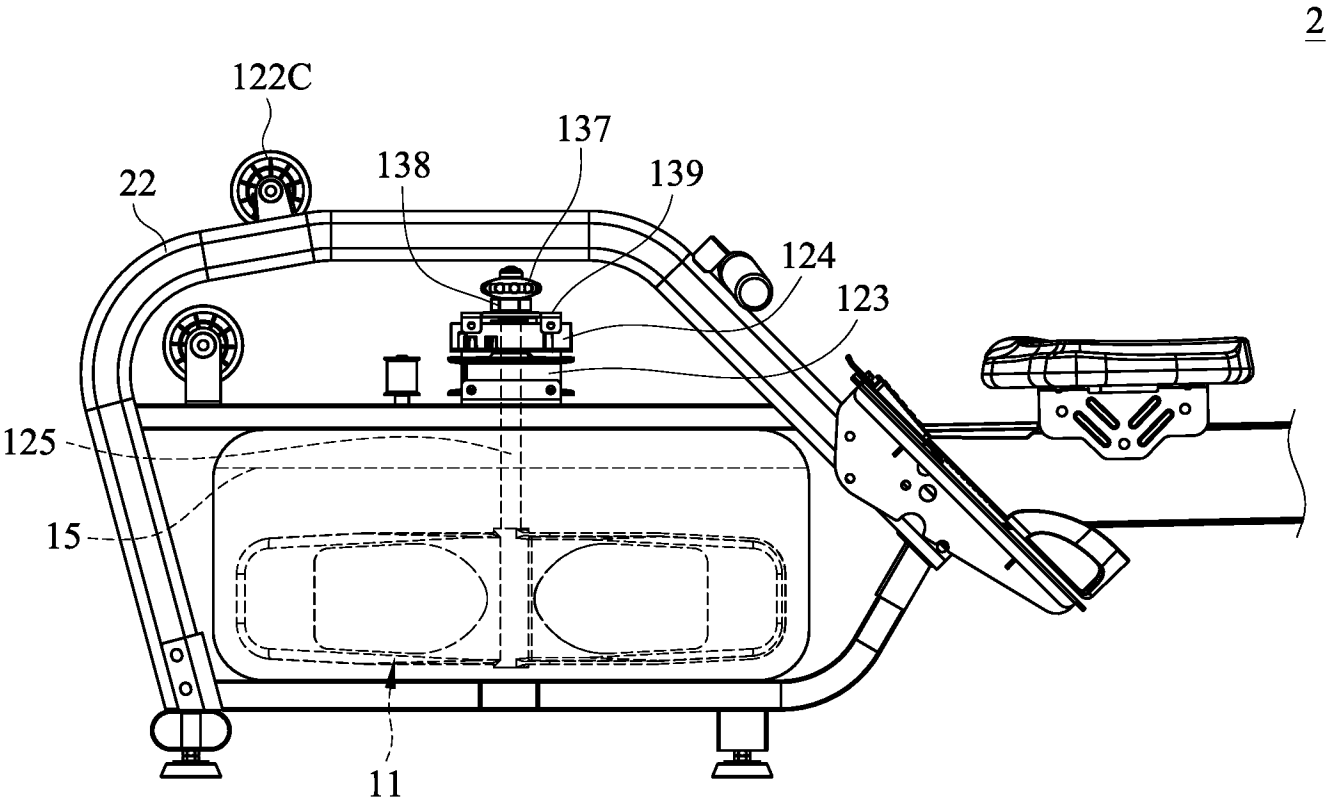
FIG. 6 is a partially side view showing the exercise machine with variable resistance in accordance with the second embodiment of the present invention.

FIG. 4 is a partially perspective view and FIGS. 5 and 6 are partially side views showing an exercise machine 2 in accordance with a second embodiment of this invention. For clarity, some components are omitted from the drawings. The second embodiment differs from the first embodiment in the adjusting device 13' and the other features are same as the first embodiment and are omitted for simplicity.

Referring to FIGS. 4-6, in this embodiment the adjusting device 13' may include a control knob 137, a nut 138, and a pedestal 139. The upper portion or end of the adjusting rod 125 is threaded to engage the internal thread of the control knob 137. The nut 138 is fixed on the pedestal 139, which is fixed with the upper supporting tube 23.

Referring to FIGS. 4-6, the operator can rotate the control knob 137 to lift or lower the adjusting rod 125. Referring to FIG. 5, the control knob 137 is rotated to lift the adjusting rod 125, leading to upward movement of the paddles 11. The depth of the paddles 11 in the fluid is decreased and hence the resistance is decreased. Referring to FIG. 6, the control knob 137 is rotated to lower the adjusting rod 125, leading to downward movement of the paddles 11. The depth of the paddles 11 in the fluid is increased and hence the resistance is increased. The degree of resistance can be adjusted by rotating the control knob 137 to a proper position.

Figure 7:
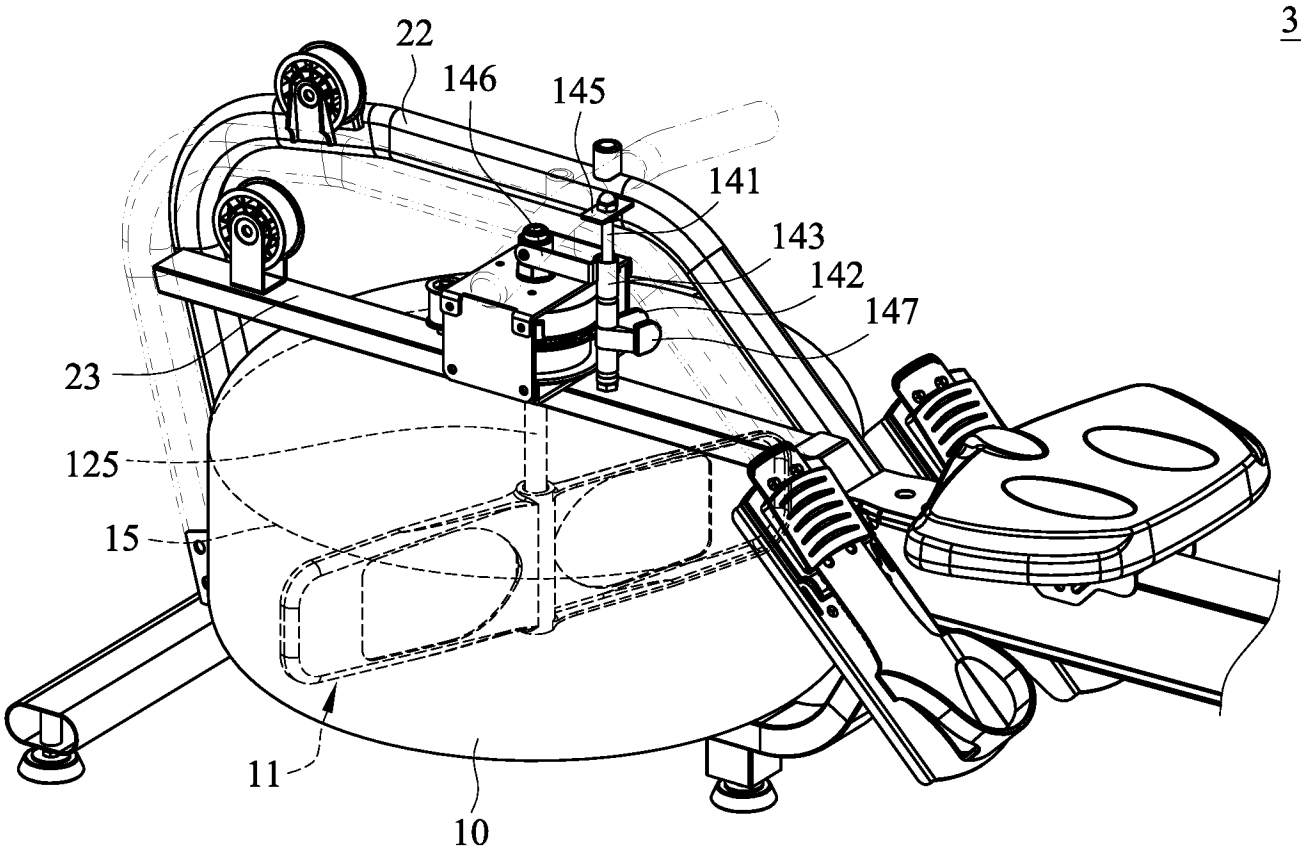
FIG. 7 is a partially perspective view showing an exercise machine with variable resistance in accordance with a third embodiment of the present invention.
Figure 8:
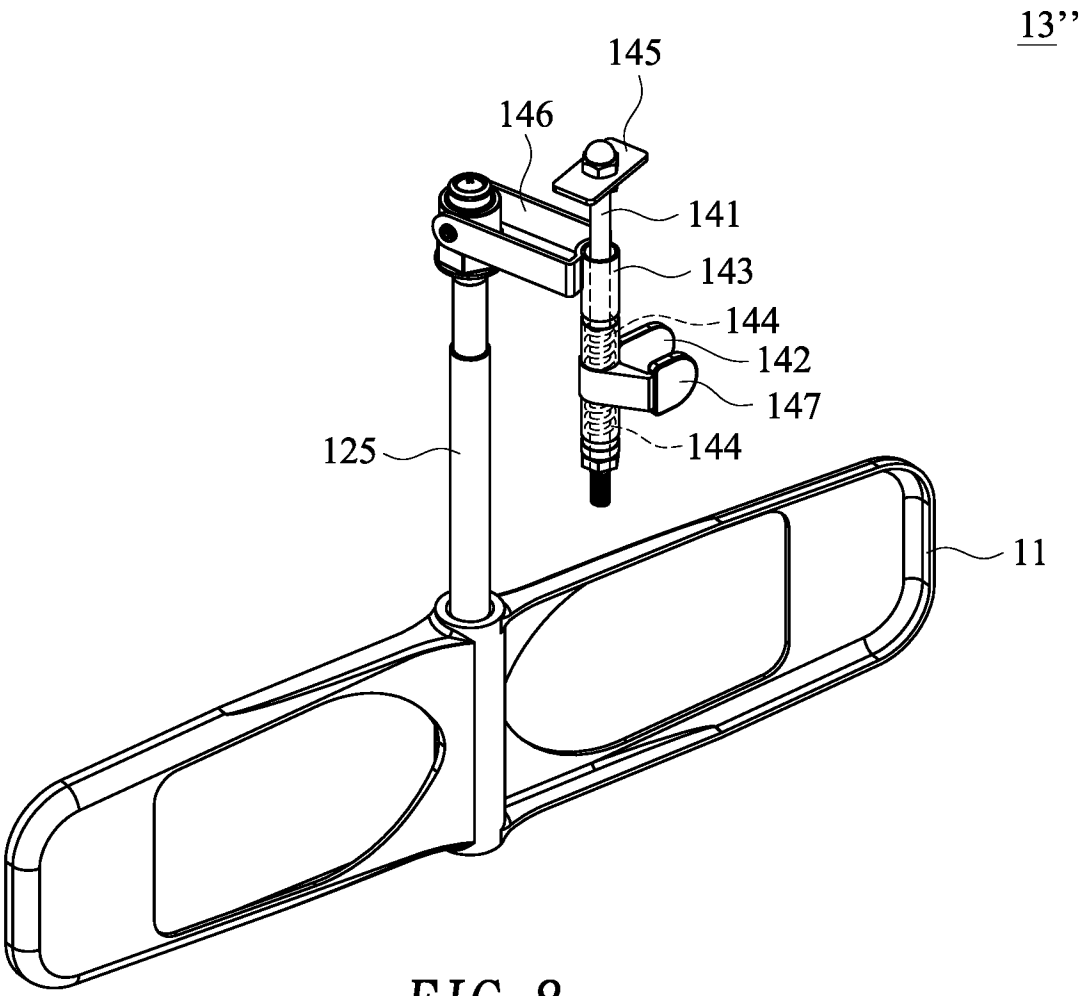
FIG. 8 is a partially perspective view showing an adjusting device of the exercise machine with variable resistance in accordance with the third embodiment of the present invention.
Figure 9:
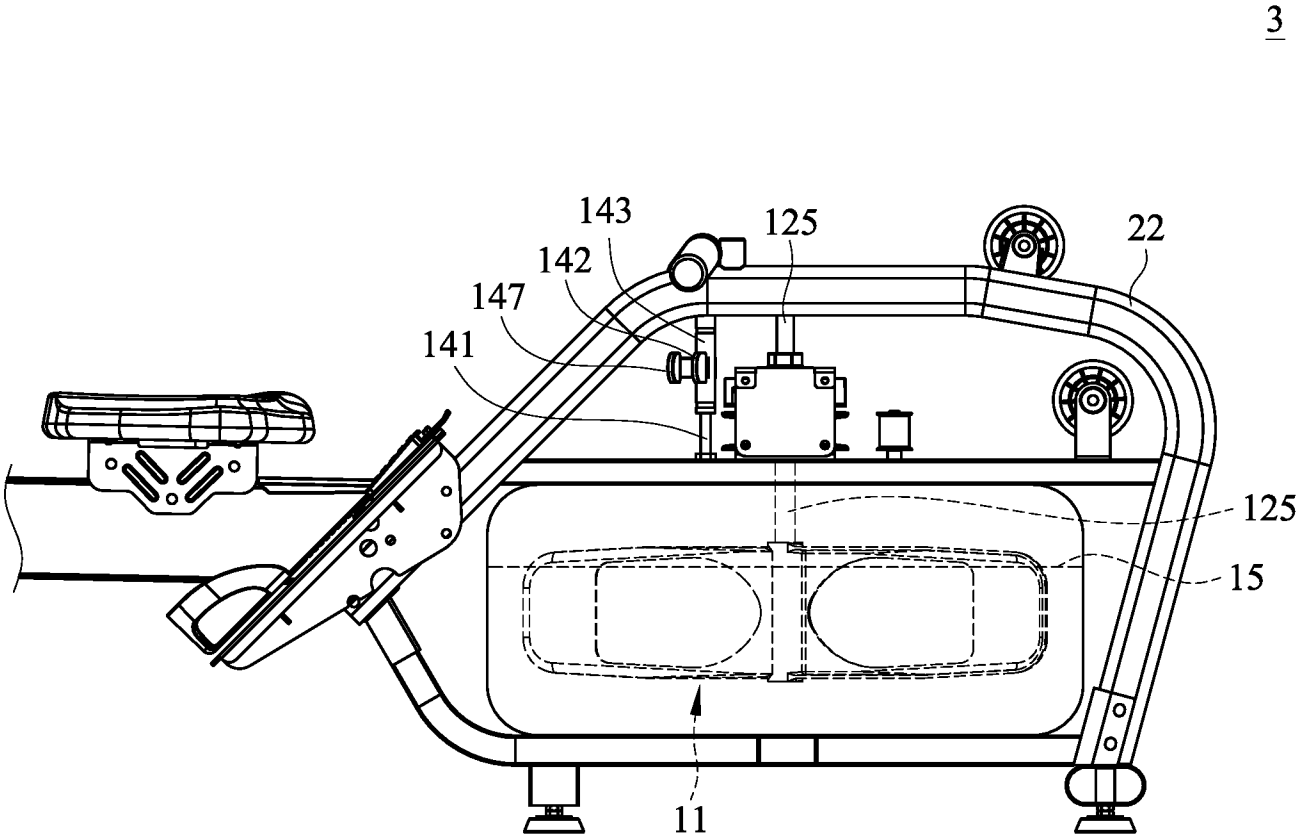
FIG. 9 is a partially side view showing the exercise machine with variable resistance in accordance with the third embodiment of the present invention.
Figure 10:
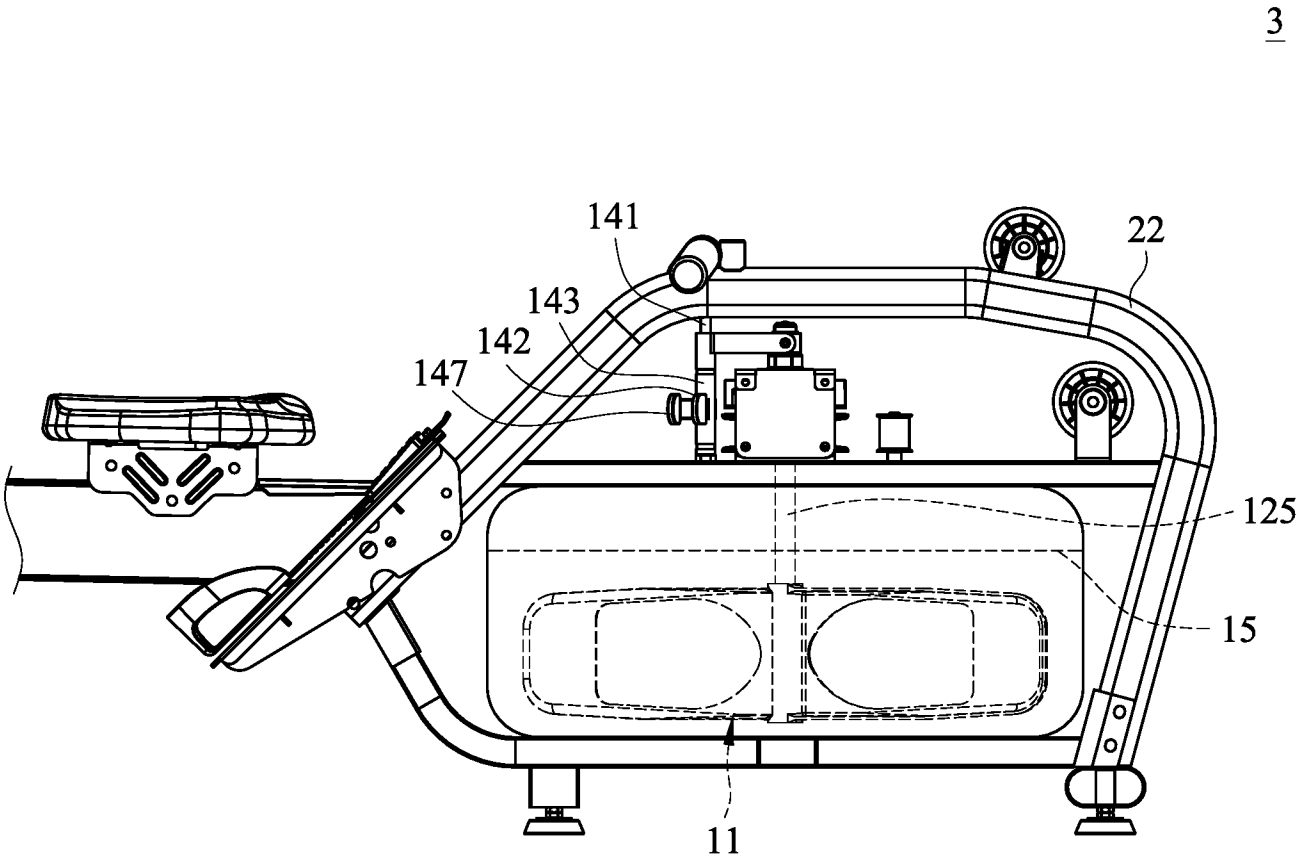
FIG. 10 is a partially side view showing the exercise machine with variable resistance in accordance with the third embodiment of the present invention.

FIGS. 7 and 8 are partially perspective views and FIGS. 9 and 10 are partially side views showing an exercise machine 3 in accordance with a third embodiment of this invention. For clarity, some components are omitted from the drawings. The third embodiment differs from the first embodiment in the adjusting device 13" and the other features are same as the first embodiment and are omitted for simplicity.

Referring to FIGS. 7 and 8, the adjusting device 13" may include a shaft 141, a control member 142, an outer shell 143, two springs 144, a supporting plate 145, a connecting member 146, and an auxiliary member 147. The supporting plate 145 is fixed between the two side tubes 22. The shaft 141 passes through the outer shell 143 and has an upper end coupled with the supporting plate 145 and a lower end coupled with the upper supporting tube 23. The control member 142 is inserted into an aperture (not shown) of the outer shell 143. The auxiliary member 147 is fixed with the outer shell 143 and is used as a support to operate the control member 142. In another embodiment of this invention, the auxiliary member 147 can be omitted. The two springs 144 are arranged inside the outer shell 143, and each spring 144 has a first end coupled with the inner wall of the outer shell 143 and a second end coupled with the control member 142.

Referring to FIGS. 7-10, the inside diameter of the two springs 144 is initially smaller than the outside diameter of the shaft 141 when the control member 142 is not operated. At this state, the shaft 141 expands the springs 144 and a counter torque force locks the shaft 141, so that the outer shell 143 cannot move along the shaft 141. When the operator operates the control member 142 by using the auxiliary member as a support, the inside diameter of the two springs 144 are increased. At this state the inside diameter of springs 144 is greater than the outside diameter of shaft 141, so that the two springs 144 does not lock the shaft 141, and the outer shell 143 can move along the shaft 141. The outer shell 143 couples with the adjusting rod 125 by the connecting member 146. The movement of the outer shell 143 will result in the movement of the adjusting rod 125.

Referring to FIG. 9, the control member 142 is operated to lift the adjusting rod 125, leading to upward movement of the paddles 11. The depth of the paddles 11 in the fluid is decreased and hence the resistance is decreased. Referring to FIG. 10, the control member 142 is operated to lower the adjusting rod 125, leading to downward movement of the paddles 11. The depth of the paddles 11 in the fluid is increased and hence the resistance is increased. The degree of resistance can be adjusted by controlling the outer shell 143 at a proper position.

Accordingly, this invention provides exercise machines allowing the operator to easily and conveniently adjust different degrees of resistance.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise machine, comprising:

a fluid container into which a fluid is poured;

one or more paddles arranged in the fluid container;

a driving device comprising an adjusting rod to couple with the one or more paddles, the adjusting rod configured to rotate the one or more paddles via a force exerted on the driving device by a user;

an adjusting device for adjusting a depth of the one or more paddles in the fluid, so as to provide different degrees of resistance for the one or more paddles;

wherein the adjusting device comprises a knob and a linking mechanism coupled with the knob and the adjusting rod, and the knob can be rotated so as to adjust the depth of the one or more paddles via the linking mechanism; and wherein the linking mechanism comprises a lateral tube, a base, a pivotal base, a linking arm, and a nut, and wherein the lateral tube is arranged between and connected with two side tubes of the exercise machine, the pivotal base couples to a bottom of the lateral tube, the base fixes with the linking arm and pivotally couples with the pivotal base, the knob is threaded to engage with the nut and then fixes with the base, and a front end of the linking arm couples with the adjusting rod.

2. The exercise machine as recited in claim 1, wherein the front end of the linking arm includes two slots and a fixing component is within each slot and fixed with an upper end of the adjusting rod.

3. An exercise machine, comprising:

a fluid container into which a fluid is poured;

one or more paddles arranged in the fluid container;

a driving device comprising an adjusting rod to couple with the one or more paddles, the adjusting rod configured to rotate the one or more paddles via a force exerted on the driving device by a user;

an adjusting device for adjusting a depth of the one or more paddles in the fluid, so as to provide different degrees of resistance for the one or more paddles;

wherein the adjusting device comprises a control knob, and an upper portion or end of the adjusting rod is threaded to engage with an internal thread of the control knob, and wherein the control knob is rotated to make an upward or downward movement of the adjusting rod.

4. The exercise machine as recited in claim 3, wherein the adjusting device further comprises a nut and a pedestal, the nut is fixed on the pedestal, and the pedestal is fixed with an upper supporting tube.

5. An exercise machine, comprising:

a fluid container into which a fluid is poured;

one or more paddles arranged in the fluid container;

a driving device comprising an adjusting rod to couple with the one or more paddles, the adjusting rod configured to rotate the one or more paddles via a force exerted on the driving device by a user;

an adjusting device for adjusting a depth of the one or more paddles in the fluid, so as to provide different degrees of resistance for the one or more paddles;

wherein the adjusting device comprises a shaft, a control member, an outer shell, two springs, a supporting plate, and a connecting member, and wherein the supporting plate is fixed with the exercise machine, the shaft passes through the outer shell and has an upper end coupled with the supporting plate and a lower end coupled with an upper supporting tube of the exercise machine, the control member is inserted into an aperture of the outer shell, the two springs are arranged inside the outer shell, each spring includes a first end coupled with an inner wall of the outer shell and a second end coupled with the control member, and the connecting member includes a front end coupled with the adjusting rod and a rear end coupled with the outer shell.

6. The exercise machine as recited in claim 5, when the control member is not operated, an inside diameter of the two springs is smaller than an outside diameter of the shaft; and when the control member is operated, the inside diameter of the two springs is greater than the outside diameter of the shaft.

7. The exercise machine as recited in claim 1, wherein the exercise machine is a rowing machine that comprises a front tube, a rear tube, the two side tubes, an upper supporting tube, a guiding track, a seat, and two pedals, and wherein the two side tubes are connected with each other and each side tube includes a front end coupled with the front tube and a rear end coupled with a front end of the guiding track, the two pedals respectively couple or pivotally couple with a left side and a right side of the guiding track, the upper supporting tube is arranged between the two side tubes and connected with the two side tubes, a rear end of the upper supporting tube couples with the front end of the guiding track, a rear end of the guiding track couples with the rear tube, and the seat can slide forward and backward on the guiding track by a wheel.

8. The exercise machine as recited in claim 7, wherein the driving device further comprises a handle, one or more rollers, a belt receiver, a belt, and a returning device, and wherein a lower end of the adjusting rod couples with the one or more paddles, the belt receiver includes a one-way bearing and a center of the belt receiver couples with the adjusting rod, the belt wraps around the belt receiver and is pulled out of the belt receiver, and the one or more rollers change a direction of the belt such that the belt then couples with the handle.

* * * * *